US007591637B2

(12) United States Patent
Muehlhausen et al.

(10) Patent No.: US 7,591,637 B2
(45) Date of Patent: Sep. 22, 2009

(54) G-ROTOR PUMP

(75) Inventors: Ralf Muehlhausen, Rotenburg (DE); Rolf Reinhardt, Rotenburg (DE)

(73) Assignee: Siemens Aktiengesellschaft, München (DE)

( * ) Notice: Subject to any disclaimer, the term of this patent is extended or adjusted under 35 U.S.C. 154(b) by 280 days.

(21) Appl. No.: 10/560,446

(22) PCT Filed: May 24, 2004

(86) PCT No.: PCT/EP2004/050895

§ 371 (c)(1),
(2), (4) Date: Dec. 13, 2005

(87) PCT Pub. No.: WO2004/113728

PCT Pub. Date: Dec. 29, 2004

(65) Prior Publication Data

US 2006/0140790 A1 Jun. 29, 2006

(30) Foreign Application Priority Data

Jun. 16, 2003 (DE) ..... 103 27 321

(51) Int. Cl.
*F04B 17/03* (2006.01)
*F01C 1/10* (2006.01)

(52) U.S. Cl. ..... 417/410.3; 418/166; 418/171

(58) Field of Classification Search ..... 417/410.3; 418/166, 171

See application file for complete search history.

(56) References Cited

U.S. PATENT DOCUMENTS

| | | | | |
|---|---|---|---|---|
| 2,830,542 | A * | 4/1958 | Erickson et al. | 418/171 |
| 3,244,111 | A * | 4/1966 | Shelhart | 418/133 |
| 4,820,138 | A | 4/1989 | Bollinger | |
| 5,122,039 | A * | 6/1992 | Tuckey | 417/366 |
| 5,156,540 | A | 10/1992 | Fernau et al. | |
| 5,350,285 | A | 9/1994 | Liskow et al. | |
| 6,053,718 | A * | 4/2000 | Schmidt et al. | 418/152 |
| 6,095,771 | A * | 8/2000 | Schelhas et al. | 417/423.14 |
| 6,402,460 | B1 * | 6/2002 | Fischer et al. | 415/55.1 |
| 6,454,521 | B1 * | 9/2002 | Anderson et al. | 415/55.1 |
| 6,755,610 | B2 * | 6/2004 | Wolters et al. | 415/55.1 |
| 2003/0039539 | A1 * | 2/2003 | Harris et al. | 415/55.1 |
| 2004/0037726 | A1 | 2/2004 | Burhenne et al. | |

FOREIGN PATENT DOCUMENTS

| | | | |
|---|---|---|---|
| DE | 40 21 500 | A1 | 1/1992 |
| DE | 42 40 592 | A1 | 6/1994 |
| DE | 43 15 432 | A1 | 11/1994 |
| DE | 198 42 016 | A1 | 3/2000 |
| DE | 101 15 866 | A1 | 10/2002 |
| EP | 0 464 261 | A1 | 1/1992 |
| EP | 1 369 588 | A1 | 12/2003 |
| JP | 11050971 | | 2/1999 |

* cited by examiner

*Primary Examiner*—Charles G Freay
(74) *Attorney, Agent, or Firm*—Cohen Pontani Lieberman & Pavane LLP

(57) ABSTRACT

Disclosed is a G-rotor pump in which a lid and a bottom of a pump housing are made of plastic. A spacer that supports the bottom is produced as a single piece with the lid, whereby the G-rotor pump can be embodied in a particularly inexpensive manner.

17 Claims, 1 Drawing Sheet

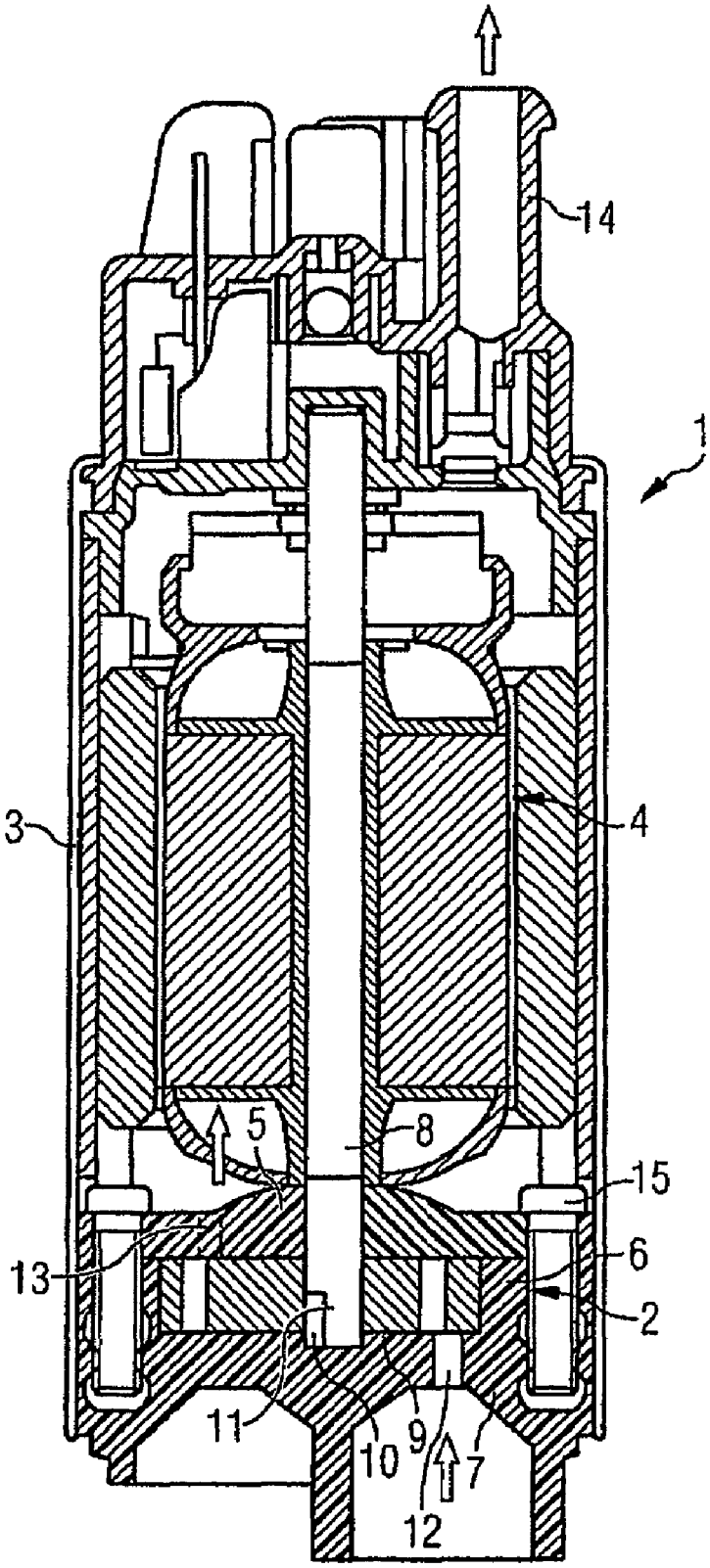
14
1
3
4
5
8
15
13
6
2
11
10
9
7
12

G-ROTOR PUMP

BACKGROUND OF THE INVENTION

1. Field of the Invention

The invention relates to a positive-displacement pump, designed as a G-rotor pump, for the conveyance of fuel in a motor vehicle, with a driven G-rotor arranged between a bottom and a cover of a pump casing and with a spacer arranged between the bottom and the cover.

2. Background of the Related Art

Such G-rotor pumps are mostly combined with an electric motor to form a conveying unit and are known from practice. The known G-rotor pump has an inlet duct in the cover and an outlet duct in the bottom facing the electric motor. The flow thereby passes axially through the G-rotor pump. The spacer has an essentially annular configuration, so as to surround the G-rotor, and holds the cover at an intended distance from the bottom. The bottom and the cover can consequently be braced relative to one another. The cover, G-rotor, bottom and spacer are manufactured from ceramic with a particularly high surface quality. The high surface quality ensures that an overflow of the conveyed fuel from the region of the outlet to the region of the inlet is avoided.

The known G-rotor pump has the disadvantage that the pump casing has a highly complicated configuration and consequently possesses components which are cost-intensive to manufacture.

The problem on which the invention is based is to design a G-rotor pump of the type initially mentioned in such a way that it can be manufactured particularly cost-effectively.

SUMMARY OF THE INVENTION

This problem is solved, according to the invention, in that the bottom and/or the cover are/is manufactured from plastic.

By virtue of this design, the pump casing can be composed of components which are particularly cost-effective to manufacture. The G-rotor pump according to the invention can thereby be manufactured particularly cost-effectively. A further advantage of the G-rotor pump according to the invention is that noises of the G-rotor are damped to a particularly great extent by the components of the pump casing which are manufactured from plastic.

The high surface quality required for reliable operation of the G-rotor pump according to the invention could be achieved, for example, by means of a coating of the bottom and/or of the cover. However, a contribution to further reducing the manufacturing costs of the G-rotor pump according to the invention is made when the bottom and/or the cover are/is lapped on their side located opposite the G-rotor.

A contribution to simplifying the assembly of the G-rotor pump according to the invention is made when the spacer is manufactured in one piece with the cover arranged on that side of the G-rotor which faces away from an electric drive. The bottom arranged on that side of the G-rotor which faces an electric drive can thereby have a planar configuration. This contributes to the further reduction in the manufacturing costs of the G-rotor pump according to the invention.

BRIEF DESCRIPTION OF THE DRAWINGS

FIG. 1 depicts a cross-sectional view of a G-rotor pump according to an embodiment of the invention.

DETAILED DESCRIPTION OF THE DRAWINGS

The invention permits numerous embodiments. To make its basic principle even clearer, one of these is illustrated in the drawing and is described below. The latter shows, in a single Figure, a longitudinal section through a fuel conveying unit 1 having a G-rotor pump 2 according to the invention.

The fuel conveying unit 1 has a housing 3 for receiving an electric motor 4 and the G-rotor pump 2. The G-rotor pump 2 has a bottom 5 and a cover 7 held at an intended distance from the bottom 5 via a spacer 6. The spacer 6 and the cover 7 are manufactured in one piece here. A G-rotor 9 fastened on a shaft 8 of the electric motor 4 is arranged between the cover 7 and the bottom 5. The shaft 8 has a flattening 10 for the rotationally fixed take-up of the G-rotor 9. Moreover, the shaft 8 has a shoulder 11 in the region of the G-rotor 9. The G-rotor 9 can thereby be connected to the shaft 8 in the depicted position only. The cover 7 has an inlet 12 and the bottom 5 an outlet 13 of the G-rotor pump 2. Fuel is thereby sucked in via the cover 7 and flows axially through the G-rotor pump 2. The housing 3 of the fuel conveying unit 1 has a connection piece 14 for connecting a line, not illustrated. The flows of the fuel are identified by arrows in the drawing for clarity.

The cover 7 and the bottom 5 are manufactured from plastic and are lapped on their side facing the G-rotor 9. As a result, the cover 7 and the bottom 5 have a particularly high surface quality and can reliably absorb noises.

Furthermore, the G-rotor pump 2 has two screws 15 which prestress the cover 7 against the bottom 5. In an alternative embodiment, not illustrated, the cover 7 is prestressed against the bottom 5 via the housing 3 of the fuel conveying unit. The use of the screws 15 can consequently be dispensed with.

What is claimed is:

1. A positive-displacement G-rotor pump for fuel in a motor vehicle, comprising:

a shaft having a flattening at one end which includes a shoulder;

a driven G-rotor arranged between a bottom and a cover of a pump casing, said shoulder of said shaft being disposed in an area of said G-rotor between said bottom and said cover and said G-rotor is configured so that said G-rotor is connectable to said shaft in only a single position; and a spacer arranged between the bottom and the cover;

wherein the bottom and the cover are manufactured entirely from plastic.

2. The G-rotor pump as claimed in claim 1, wherein the bottom or the cover is lapped on the side facing toward the G-rotor.

3. The G-rotor pump as claimed in claim 1, wherein the spacer is manufactured in one piece with the cover arranged on the side of the G-rotor opposite an electric drive.

4. The G-rotor pump of claim 1, wherein said bottom is lapped on the side facing the G-rotor and wherein said cover is lapped on the side facing toward the G-rotor.

5. The G-rotor pump of claim 1, wherein the G-rotor is manufactured from ceramic.

6. A G-rotor pump comprising:

an electric motor having;

a shaft having a flattening at one end which includes a shoulder;

a pump casing having a bottom and a cover, said bottom and cover being separated by a spacer; and a G-rotor attached to said shaft, said G-rotor being located between the bottom and cover;

wherein said shoulder of said shaft is disposed in an area of said G-rotor between said bottom and said cover and said G-rotor is configured so that said G-rotor is connectable to said shaft in only a single position, and wherein the bottom and cover are made entirely of plastic.

7. The G-rotor pump of claim 6, wherein said bottom or said cover has a high surface quality coating.

8. The G-rotor pump of claim 7, wherein said bottom and said cover have a high surface quality coating.

9. The G-rotor pump of claim 6, wherein said bottom or said cover is lapped on the side facing toward said G-rotor.

10. The G-rotor pump of claim 6, wherein said spacer and said cover are made in one piece.

11. The G-rotor pump of claim 6, wherein said cover is located on the side of the G-rotor opposite said electric motor.

12. The G-rotor pump of claim 11, wherein said bottom has a planar configuration.

13. The G-rotor pump of claim 6, wherein said cover has an inlet and said bottom has an outlet; wherein fluid flows into the inlet, axially through the G-rotor pump, and out of the outlet.

14. The G-rotor pump of claim 6, wherein said cover is prestressed against said bottom.

15. The G-rotor pump of claim 6, further comprising a housing; wherein said housing prestresses said cover against said bottom.

16. The G-rotor pump of claim 6, wherein the G-rotor is made of ceramic.

17. A positive-displacement G-rotor pump for fuel in a motor vehicle, comprising:

a shaft having a flattening at one end which includes a shoulder, and an opposing end connectable to an electric drive;

a driven G-rotor rotationally fixed to said shaft, said G-rotor being arranged between a bottom and a cover of a pump casing; and a spacer arranged between the bottom and the cover;

wherein the bottom and the cover are manufactured entirely from plastic and the spacer and the cover are manufactured in one piece, the cover being arranged on a side of the G-rotor opposite the opposing end of the shaft, and wherein the shoulder of the shaft and said G-rotor are configured to define only a single position in which the shaft is connectable to the G-rotor.

* * * * *